US012139992B2

(12) United States Patent
Watson et al.

(10) Patent No.: US 12,139,992 B2
(45) Date of Patent: Nov. 12, 2024

(54) DISCRETE PLUGGING DEVICE LAUNCHER

(71) Applicant: THRU TUBING SOLUTIONS, INC., Newcastle, OK (US)

(72) Inventors: Brock W. Watson, Sadler, TX (US); Erik Jorgensen, Oklahoma City, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 244 days.

(21) Appl. No.: 17/617,108

(22) PCT Filed: Jun. 18, 2020

(86) PCT No.: PCT/US2020/038453
§ 371 (c)(1),
(2) Date: Dec. 7, 2021

(87) PCT Pub. No.: WO2020/257467
PCT Pub. Date: Dec. 24, 2020

(65) Prior Publication Data

US 2022/0228456 A1 Jul. 21, 2022

Related U.S. Application Data

(60) Provisional application No. 62/864,310, filed on Jun. 20, 2019.

(51) Int. Cl.
*E21B 33/068* (2006.01)
*E21B 33/138* (2006.01)

(52) U.S. Cl.
CPC ..... *E21B 33/068* (2013.01); *E21B 33/138* (2013.01)

(58) Field of Classification Search
CPC ..... E21B 33/138
See application file for complete search history.

(56) References Cited

U.S. PATENT DOCUMENTS 1,938,955 A * 12/1933 Crowell ..... E21B 33/16 166/154
2,157,493 A 5/1939 Miller et al.
(Continued)

FOREIGN PATENT DOCUMENTS

| | | | |
|---|---|---|---|
| EP | 0787889 | A2 | 8/1997 |
| WO | 2013184238 | A1 | 12/2013 |
| WO | 2014042552 | A1 | 3/2014 |
| WO | 2015081092 | A2 | 6/2015 |

OTHER PUBLICATIONS

Exico Dictionary; "body", Definition of body in English, dated Sep. 17, 2019, 7 pages.

(Continued)

*Primary Examiner* — Christopher J Sebesta
*Assistant Examiner* — Neel Girish Patel
(74) *Attorney, Agent, or Firm* — Smith IP Services, P.C.

(57) ABSTRACT

A plugging device launcher for use with a subterranean well can include a release mechanism. The release mechanism can include an actuator operative to displace at least one elongated member. The elongated member is engaged with at least one plugging device. A method of releasing plugging devices into a subterranean well can include placing a plugging device launcher in communication with a wellbore of the well, and operating an actuator of the plugging device launcher, thereby displacing at least one elongated member of the plugging device launcher. The displacing step can include disengaging the elongated member from at least one of the plugging devices.

22 Claims, 12 Drawing Sheets

(56) References Cited

U.S. PATENT DOCUMENTS 2,754,910 A 7/1956 Derrick et al.
2,788,072 A 4/1957 Goodwin
2,790,500 A * 4/1957 Jones ..... E21B 33/068 15/104.062
2,838,117 A 6/1958 Clark, Jr. et al.
2,970,645 A 2/1961 Glass et al.
3,011,196 A * 12/1961 Glover ..... F16L 55/46 15/104.062
3,011,548 A 12/1961 Holt
3,028,996 A * 4/1962 Ellett ..... F16L 55/46 15/104.062
3,170,517 A 2/1965 Graham et al.
3,174,546 A 3/1965 Flickiner
2,768,693 A 10/1965 Hughes, Jr.
3,292,700 A 12/1966 Berry
3,376,934 A 4/1968 Willman et al.
3,399,726 A 9/1968 Harris et al.
3,434,539 A 3/1969 Merritt
3,437,147 A 4/1969 Davies
3,480,079 A 11/1969 Guinn et al.
3,595,314 A 7/1971 Garner
3,707,194 A 12/1972 Svaldi
3,814,187 A 6/1974 Holman
3,895,678 A 7/1975 Wright et al.
4,132,243 A * 1/1979 Kuus ..... E21B 33/068 15/104.062
4,187,909 A 2/1980 Erbstoesser
4,194,561 A 3/1980 Stokley et al.
4,505,334 A 3/1985 Doner et al.
4,716,964 A 1/1988 Erbstoesser et al.
4,759,469 A * 7/1988 Lowrance ..... B65G 33/04 29/889
4,917,184 A * 4/1990 Freeman ..... E21B 33/05 166/70
4,921,577 A 5/1990 Eubank
5,004,048 A 4/1991 Bode
5,507,345 A 4/1996 Wehunt, Jr. et al.
5,692,565 A * 12/1997 MacDougall ..... E21B 49/00 166/264
5,890,536 A 4/1999 Nierode et al.
5,908,073 A 6/1999 Nguyen et al.
6,394,184 B2 5/2002 Tolman et al.
6,427,776 B1 8/2002 Hoffman et al.
7,451,823 B2 * 11/2008 Wilson ..... E21B 27/02 166/372
7,527,095 B2 5/2009 Bloess et al.
7,565,929 B2 7/2009 Bustos et al.
7,571,773 B1 8/2009 West et al.
7,891,424 B2 2/2011 Creel et al.
8,256,515 B2 9/2012 Barbee
8,307,916 B1 11/2012 Wald
8,596,362 B2 12/2013 Nelson
8,757,260 B2 6/2014 Luo et al.
8,851,172 B1 10/2014 Dudzinski
8,950,438 B2 2/2015 Ryan
8,950,491 B2 2/2015 Frost
9,187,975 B2 11/2015 Rochen
9,284,798 B2 3/2016 Jamison et al.
9,334,704 B2 5/2016 Mineo et al.
9,745,820 B2 8/2017 Watson et al.
9,816,341 B2 11/2017 Funkhouser et al.
10,233,719 B2 3/2019 Schultz et al.
10,513,653 B2 12/2019 Schultz et al.
10,513,902 B2 12/2019 Funkhouser et al.
10,641,057 B2 5/2020 Schultz et al.
10,641,069 B2 5/2020 Schultz et al.
10,641,070 B2 5/2020 Schultz et al.
10,655,427 B2 5/2020 Schultz et al.
10,738,564 B2 8/2020 Watson et al.
10,753,174 B2 8/2020 Watson et al.
11,242,723 B2 * 2/2022 Pedraza ..... E21B 43/26
2002/0148611 A1 * 10/2002 Williger ..... E21B 43/119 166/55.1
2003/0155114 A1 * 8/2003 Pedersen ..... E21B 34/14 166/70
2005/0184083 A1 8/2005 Diaz et al.
2006/0113077 A1 6/2006 Willberg et al.
2006/0169449 A1 8/2006 Mang et al.
2006/0213662 A1 9/2006 Creel et al.
2007/0169935 A1 7/2007 Akbar et al.
2008/0000639 A1 1/2008 Clark et al.
2008/0053660 A1 * 3/2008 Angman ..... E21B 19/06 166/373
2008/0148994 A1 6/2008 Magnin
2008/0196896 A1 8/2008 Bustos et al.
2008/0200352 A1 8/2008 Willberg et al.
2008/0209243 A1 8/2008 Ghiasi et al.
2008/0223587 A1 * 9/2008 Cherewyk ..... E21B 33/068 166/69
2010/0122813 A1 5/2010 Trummer et al.
2010/0147886 A1 6/2010 Witkowski et al.
2010/0152070 A1 6/2010 Ghassemzadeh
2011/0048712 A1 3/2011 Barbee
2011/0226479 A1 9/2011 Tippel et al.
2011/0297396 A1 12/2011 Hendel et al.
2012/0037374 A1 * 2/2012 Schuurman ..... E21B 33/035 166/360
2012/0085548 A1 4/2012 Fleckenstein et al.
2012/0181032 A1 7/2012 Naedler et al.
2012/0211219 A1 * 8/2012 McGuire ..... E21B 33/068 166/75.15
2012/0279717 A1 * 11/2012 Young ..... E21B 33/068 166/318
2012/0285695 A1 11/2012 Lafferty et al.
2013/0098600 A1 4/2013 Roberts
2013/0161005 A1 * 6/2013 Yates ..... E21B 33/05 166/284
2013/0233553 A1 9/2013 Burgrin et al.
2014/0022364 A1 1/2014 Rodriguez et al.
2014/0022537 A1 1/2014 Samson et al.
2014/0034301 A1 * 2/2014 Leblanc ..... E21B 47/005 166/250.14
2014/0116712 A1 5/2014 Bansal et al.
2014/0274815 A1 9/2014 Lovett et al.
2014/0299334 A1 10/2014 Hallundbaek et al.
2015/0021011 A1 * 1/2015 Bihun ..... E21B 33/068 166/75.15
2015/0060072 A1 3/2015 Busby et al.
2015/0075793 A1 3/2015 Dotson et al.
2015/0083423 A1 3/2015 Brannon et al.
2015/0090453 A1 4/2015 Tolman et al.
2015/0122364 A1 5/2015 Cheatham, III et al.
2016/0251930 A1 9/2016 Jacob et al.
2016/0319630 A1 11/2016 Watson et al.
2017/0022777 A1 * 1/2017 Allen ..... E21B 43/2607
2017/0030169 A1 2/2017 Funkhouser et al.
2017/0107784 A1 4/2017 Watson et al.
2017/0107785 A1 4/2017 Schultz et al.
2017/0107786 A1 4/2017 Schultz et al.
2017/0260828 A1 * 9/2017 Watson ..... E21B 23/08
2017/0275961 A1 9/2017 Schultz et al.
2017/0275965 A1 9/2017 Watson et al.
2017/0292343 A1 10/2017 Watson et al.
2017/0292344 A1 10/2017 Watson et al.
2017/0335651 A1 11/2017 Watson et al.
2018/0128133 A1 5/2018 Rehm
2018/0135394 A1 5/2018 Tolman
2018/0245439 A1 8/2018 Entchev et al.
2018/0313182 A1 * 11/2018 Cherewyk ..... E21B 33/068
2018/0313206 A1 * 11/2018 Dirksen ..... E21B 47/13
2019/0085657 A1 * 3/2019 Allen ..... E21B 34/02
2019/0257172 A1 8/2019 Watson
2020/0056440 A1 * 2/2020 Golinowski ..... E21B 33/068
2020/0347695 A1 5/2020 Watson
2020/0190934 A1 * 6/2020 Young ..... E21B 33/068

OTHER PUBLICATIONS

Lexico Dictionary; "knot", Main definitions of knot in English, dated Sep. 17, 2019, 8 pages.

(56) References Cited

OTHER PUBLICATIONS

International Search Report with Written Opinion issued Dec. 30, 2021 for PCT Patent Application No. PCT/US2020/038453, 8 pages.
Oxford Dictionaries; "Definition of Body in English", dated May 23, 2019, 7 pages.
Merriam Webster; "Definition of Bundle", dated Nov. 7, 2017, 13 pages.
The Free Dictionary; "Definition of Bundle", dated Nov. 7, 2017, 10 pages.
Perf Sealers; "History of Perforation Ball Sealers in the Oil and Gas Industry", Web article via https://www.perfsealers.com/history-of-perforation-ball-sealers/ (year: 2014), dated 2014-2019, 4 pages.
Saudi Arabia Substantive Examination Report issued Sep. 19, 2023 for SA Patent Application No. 521431116, 6 pages.
English translation of Saudi Arabia Substantive Examination Report issued Sep. 19, 2023 for SA Patent Application No. 521431116, 8 pages.

* cited by examiner

DISCRETE PLUGGING DEVICE LAUNCHER

CROSS-REFERENCE TO RELATED APPLICATIONS

This application is a national stage under 35 USC 371 of International Application No. PCT/US20/38453 filed on 18 Jun. 2020, which claims the benefit of the filing date of U.S. Provisional Application No. 62/864,310 filed on 20 Jun. 2019. The entire disclosures of these prior applications are incorporated herein by this reference.

TECHNICAL FIELD

This disclosure relates generally to equipment utilized and operations performed in conjunction with a subterranean well and, in examples described below, more particularly provides a discrete plugging device launcher.

BACKGROUND

Plugging devices can be used to plug perforations in subterranean wells. Typically, plugging devices are deployed as a group into a well, with the number of plugging devices being equal to, or greater than, the number of perforations, so that all perforations are plugged.

However, it can be difficult to ensure that every plugging device will plug a respective perforation. For example, if two plugging devices are displacing toward a last, deepest perforation, only one of the plugging devices will typically be able to plug the perforation.

It will, therefore, be readily appreciated that improvements are continually needed in the art of deploying plugging devices into subterranean wells. It is among the objects of the present disclosure to provide such improvements to the art.

DETAILED DESCRIPTION

Figure 1:
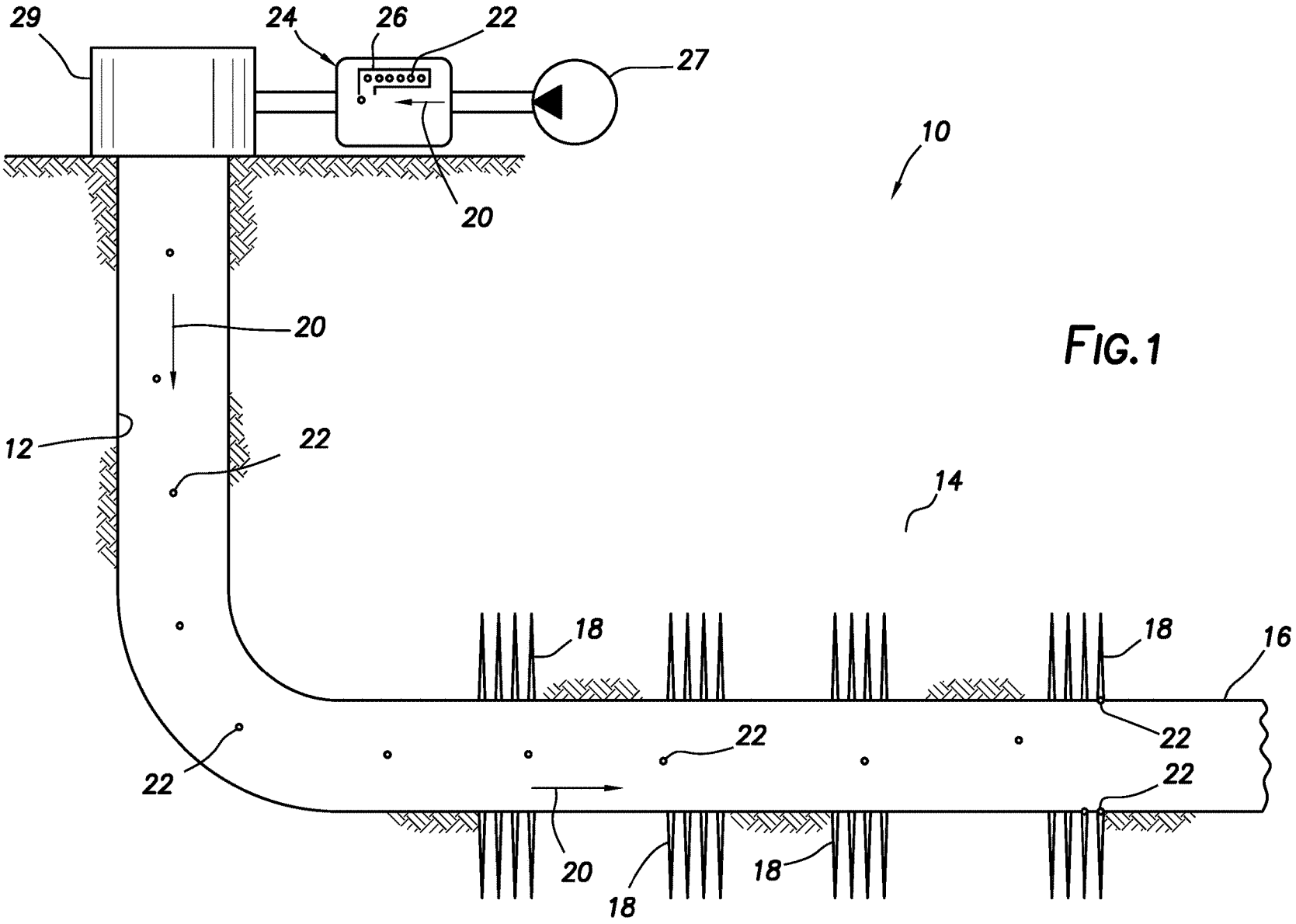
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into an earth formation 14. The wellbore 12 is lined with casing 16. Perforations 18 are formed through the casing 16 (and any surrounding cement) and into the formation 14 to thereby provide fluid communication between the wellbore 12 and the formation 14.

Although the perforations 18 are depicted in FIG. 1 as being formed in a generally horizontal section of the wellbore 12, in other examples the perforations could be formed in a generally vertical or inclined section of the wellbore. The perforations 18 may be divided into separate groups, sets or clusters as depicted in FIG. 1, or the perforations may be in a single group, set or cluster. Instead of the casing 16, a liner, tubing, pipe or other type of tubular may form a protective lining for the wellbore 12. Thus, the scope of this disclosure is not limited to any particular details of the system 10 as representatively illustrated in FIG. 1.

It is desired in the FIG. 1 example to plug off some or all of the perforations 18. For example, in a treatment or stimulation operation (such as, a fracturing, acidizing, conformance or permeability modifying operation), it can be beneficial to plug off perforations 18 that initially receive most of an injected fluid 20 flow, so that other zones or portions of the formation 14 can receive a desired volume of the injected fluid. The injected fluid 20 may be any type of treatment fluid (such as, water, brine, acid, gel, breaker, conformance agent, permeability modifier, etc.) or any other fluid suitable for injection into the wellbore 12 or formation 14.

Plugging devices 22 are conveyed with the flow of the fluid 20 to the perforations 18 in this example. When one of the plugging devices 22 engages or seats on a perforation 18, flow of the fluid 20 into the formation 14 via that perforation is blocked by the plugging device. Suitable plugging devices for use in the system 10 are described in US publication no. 2017/0260828, the entire disclosure of which is incorporated herein by this reference. However, the scope of this disclosure is not limited to use of any particular type or configuration of the plugging devices.

To assist with deployment of the plugging devices 22 into the wellbore 12, the system 10 includes a discrete plugging device launcher 24. The plugging device launcher 24 includes a controllable release mechanism 26 that releases one or more plugging device(s) 22 at a controlled rate into the flow of the fluid 20.

As depicted in FIG. 1, the plugging device launcher 24 is connected between a pump 27 and a wellhead 29. The pump 27 pumps the fluid 20 through the plugging device launcher 24 and into the wellhead 29. When it is desired to release one or more plugging device 22 into the fluid 20 flow, the release mechanism 26 is appropriately actuated, as described more fully below.

Representatively illustrated in FIGS. 2-13 are examples of the plugging device launcher 24 and release mechanism 26 thereof, and associated methods, which can embody principles of this disclosure. However, it should be clearly understood that these are merely examples of applications of the principles of this disclosure in practice, and a wide variety of other examples are possible. Therefore, the scope of this disclosure is not limited at all to the details of the plugging device launcher 24, release mechanism 26 and method examples described herein and/or depicted in the drawings.

Plugging devices are sometimes used to completely plug a group of perforations in a well. A common reason to plug up every perforation is for plug replacement. The number of perforations may range from as few as 1 to more than 100.

When deployed into a well with fluid flow, plugging devices can have three fluid forces acting on them that affect where an individual plugging device will land in a group of open perforations. A first force is fluid drag that is pushing the plugging device down hole with fluid flow. A second force is fluid drag that pushes a plugging device radially toward a perforation with fluid flow into the perforation, as the plugging device approaches the location of the perforation. The radial distance, relative to the casing, from the perforation to the plugging device has a strong effect on fluid drag pulling a plugging device to the perforation. A third force is a holding force on a perforation when the downhole fluid drag is still pulling it. Perforation size, perforation location, and the amount of fluid a perforation is taking all affect the location where a plugging device will land (engage and block flow through an opening such as a perforation).

The last (deepest, farthest downhole) open perforation has a downhole drag force of zero and generally will not be passed up by a plugging device on a horizontal well. The gravitational effect acting on a plugging device in a vertical well is very small and should typically be smaller than the force pulling the plugging device to the last open perforation. Typically, the last perforation is readily plugged with a plugging device.

It has been found in testing that if a single plugging device is pumped through a group of open perforations, the plugging device will tend to land approximately in a center of the group of perforations. If a group of plugging devices are released and pumped close together, they will also tend to start seating at about a half way point of the group of perforations. Plugging devices do not move uphole because there is no fluid movement in that direction.

Plugging devices are preferably generously spaced apart during release, so that the upper (shallowest, farthest uphole) perforations, as each of them eventually become the last (deepest) open perforation, will each have a plugging device at or above it as this occurs.

The plugging device launcher is preferably able to release plugging devices slowly, in order to space them out enough to accomplish a complete plugging of every perforation. If the plugging devices are released too slow, displacement water or treatment fluid and time are wasted (each of them being costly). A nominal desired spacing between plugging devices is the time it takes for a plugging device to travel a distance from the very top (shallowest) perforation to the very last (deepest) perforation. In practice, the spacing is generally less than this to save time and fluid.

Since the length and number of perforations varies greatly from well to well, it is desirable to have a release mechanism that is easily adjusted to space out plugging devices to a minimum amount, without too much excess. There are occasions when it is desirable to release plugging devices in a large, tight group.

In examples described herein, plugging devices can be released via a downhole wireline conveyed device and through a surface plugging device launcher. In some examples, both may be used together.

A basic mechanism for releasably securing plugging devices described herein is a pin that penetrates the plugging device through an opening (such as, a loop in threads or fibers of the plugging devices, a rigid loop of the plugging device, a piece of tape with a hole in it or a drilled hole in the plugging device). The plugging device is released by retracting the pin from the opening.

The pin may be a wire, a string, a rod, a paper or plastic clip, or any type of elongated device. The pin may be long such that, as the pin is retracted, plugging devices are released in sequence. The pin may be retracted continuously or in discrete movements to control a rate at which plugging devices are released. The pin may be removed axially, radially, tangentially, or a combination of these.

Figure 2:
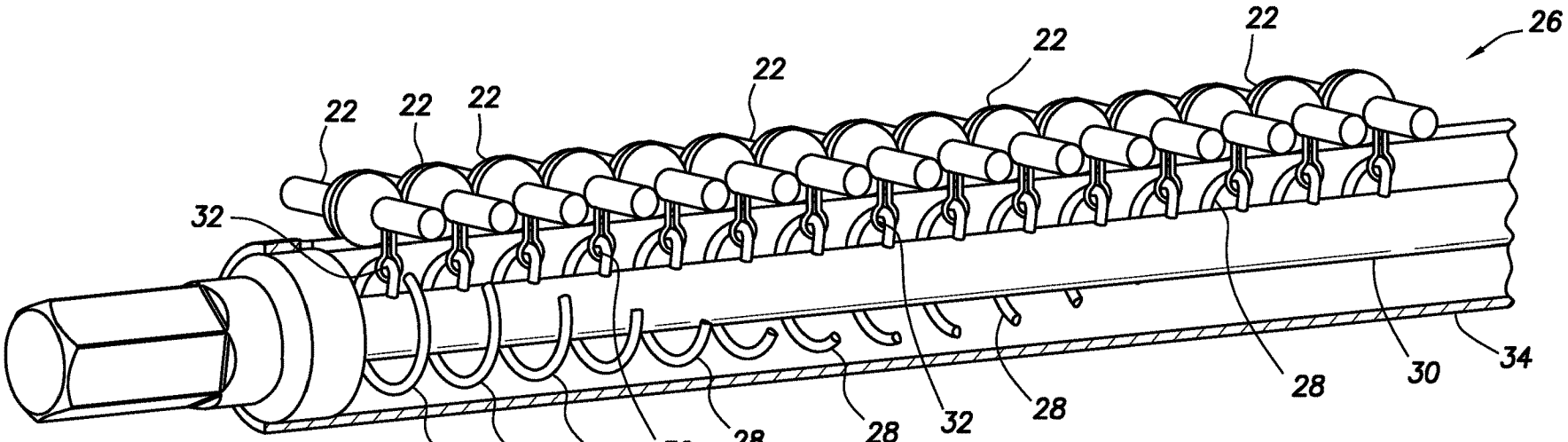
FIG. 2 is a representative perspective and partially cross-sectional view of an example of a release mechanism of a plugging device launcher that may be used in the FIG. 1 system and method, and that can embody the principles of this disclosure.
Figure 3:
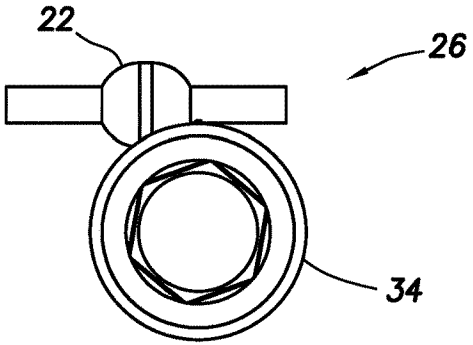
FIG. 3 is a representative end view of the release mechanism.

Referring additionally now to FIGS. 2 & 3, an example of the release mechanism 26 is representatively illustrated, apart from the remainder of the system 10 and the plugging device launcher 24. The FIGS. 2 & 3 release mechanism 26 (as well as other examples of the release mechanism described herein) may be used with the system 10, plugging device launcher 24 and method of FIG. 1, or it may be used with other systems, plugging device launchers and methods.

In the FIGS. 2 & 3 example, each of multiple plugging devices 22 is retained by a circumferentially extending elongated member 28 (such as a wire or pin) attached to a rotatable rod or shaft 30. An individual circular member 28 may extend more than once about the shaft 30 to allow for more than 360° of rotation prior to release of the corresponding plugging device 22.

Each member 28 is received in an opening 32 (for example, a hole, loop, etc.), of the plugging device 22 that is inserted through a wall of a tube 34. In this example, the opening 32 is formed by a loop of wire extending outward from the plugging device 22.

While the member 28 remains in the opening 32, the corresponding plugging device 22 is retained adjacent the tube 34. When the shaft 30 is rotated, the plugging devices 22 are sequentially released from the respective members 28 for deployment into a well.

As depicted in FIGS. 2 & 3, the members 28 have different circumferential lengths. Thus, a respective one of the plugging devices 22 will first be released from the shortest member 28, a respective one of the plugging devices will then be released from the next shortest member, etc., as the shaft 30 is rotated.

In other examples, multiple members 28 could have the same length, so that multiple plugging devices 22 are released at the same time. Alternatively, multiple plugging devices 22 can be released at the same time by retaining the multiple plugging devices on a same member 28.

Note that a speed of rotation of the shaft 30 is proportional to a rate of release of the plugging devices 22 from the release mechanism 26. Faster rotation of the shaft 30 will result in an increased rate of release of the plugging devices 22, and slower rotation of the shaft will result in a decreased rate of release of the plugging devices.

Figure 4:
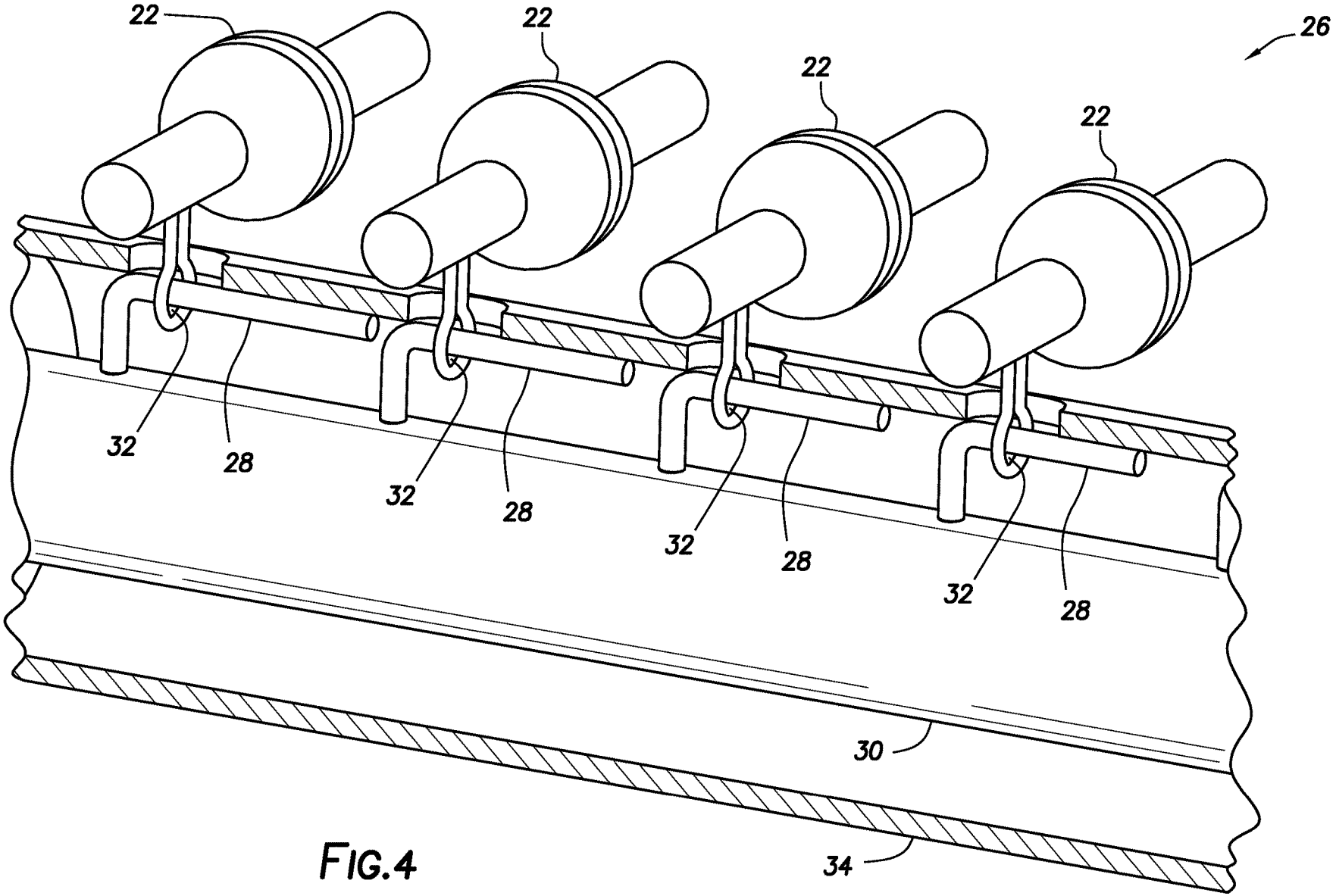
FIG. 4 is a representative perspective and partially cross-sectional view of another example of the release mechanism.

Referring additionally now to FIG. 4, another example of the release mechanism 26 is representatively illustrated. In this example, the shaft 30 is displaced axially or longitudinally, instead of rotated, in order to release the plugging devices 22.

As depicted in FIG. 4, multiple plugging devices 22 are retained by multiple elongated members 28 secured to the shaft 30. The members 28 are received in the openings 32 of the plugging devices 22 that are extended through a wall of the tube 34. Note that the members 28 in this example extend longitudinally, instead of circumferentially (as in the FIGS. 2 & 3 example).

While a member 28 remains in an opening 32, the corresponding plugging device 22 is retained adjacent the tube 34. When the shaft 30 is displaced axially or longitudinally, the plugging devices 22 are sequentially released from the respective members 28 for deployment into a well.

As depicted in FIGS. 4, the members 28 have different lengths. Thus, a respective one of the plugging devices 22 will first be released from the shortest member 28, a respective one of the plugging devices will then be released from the next shortest member, etc., as the shaft 30 is displaced.

In other examples, multiple members 28 could have the same length, so that multiple plugging devices 22 are released at the same time. Alternatively, multiple plugging devices 22 can be released at the same time by retaining the multiple plugging devices on a same member 28.

Note that a speed of displacement of the shaft 30 is proportional to a rate of release of the plugging devices 22 from the release mechanism 26. Faster displacement of the shaft 30 will result in an increased rate of release of the plugging devices 22, and slower displacement of the shaft will result in a decreased rate of release of the plugging devices.

Figure 5:
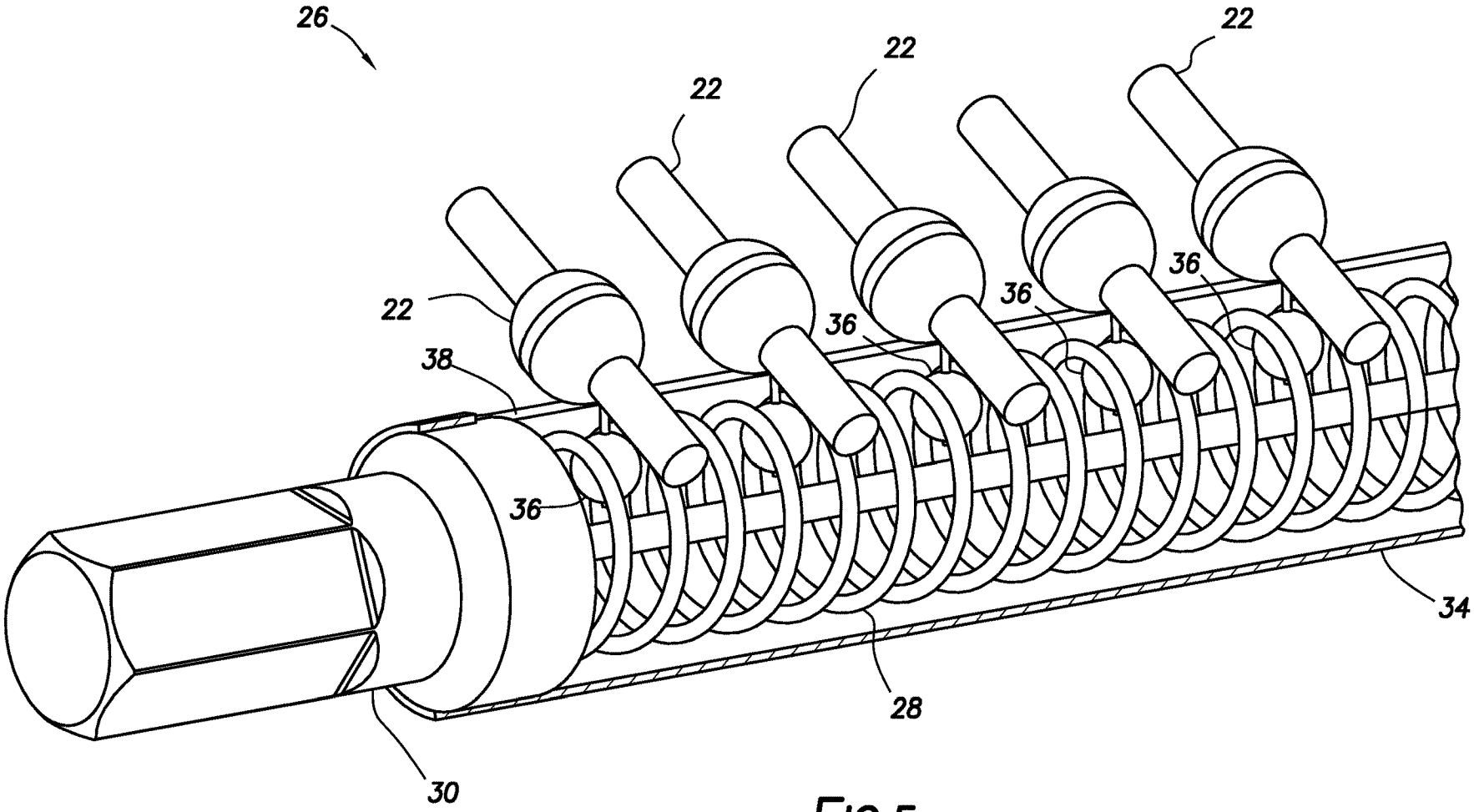
FIG. 5 is a representative perspective and partially cross-sectional view of another example of the release mechanism.

Referring additionally to FIG. 5, another example of the release mechanism 26 is representatively illustrated. In this example, the member 28 is in the form of a helically extending coil (such as, a wire coil or spring). Each plugging device 22 includes an outwardly extending object 36 positioned between adjacent coils of the member 28.

In the FIG. 5 example, the object 36 is in the form of a knob or ball extending through a slot 38 in the tube 34 and between coils of the member 28. The object 36 could be anything that is too big to pass through the slot 38 (such as a knot tied in a string).

An opening (such as the opening 32 in the FIGS. 2-4 examples) could be used in place of the object 36. For example, the member 28 of FIG. 5 could be received in a loop of string, fiber, plastic, metal, etc. extending outward from each of the plugging devices 22.

As the member 28 is rotated in the FIG. 5 example, the plugging devices 22 are advanced along the tube 34 between the coils. At an end of the tube 34 (or at a location where the slot 38 is enlarged so that the object 36 can pass through the slot), each plugging device 22 is eventually released into the well.

Note that a speed of rotation of the shaft 30 and member 28 is proportional to a rate of release of the plugging devices 22 from the release mechanism 26. Faster rotation of the shaft 30 will result in an increased rate of release of the plugging devices 22, and slower rotation of the shaft will result in a decreased rate of release of the plugging devices.

Figure 6:
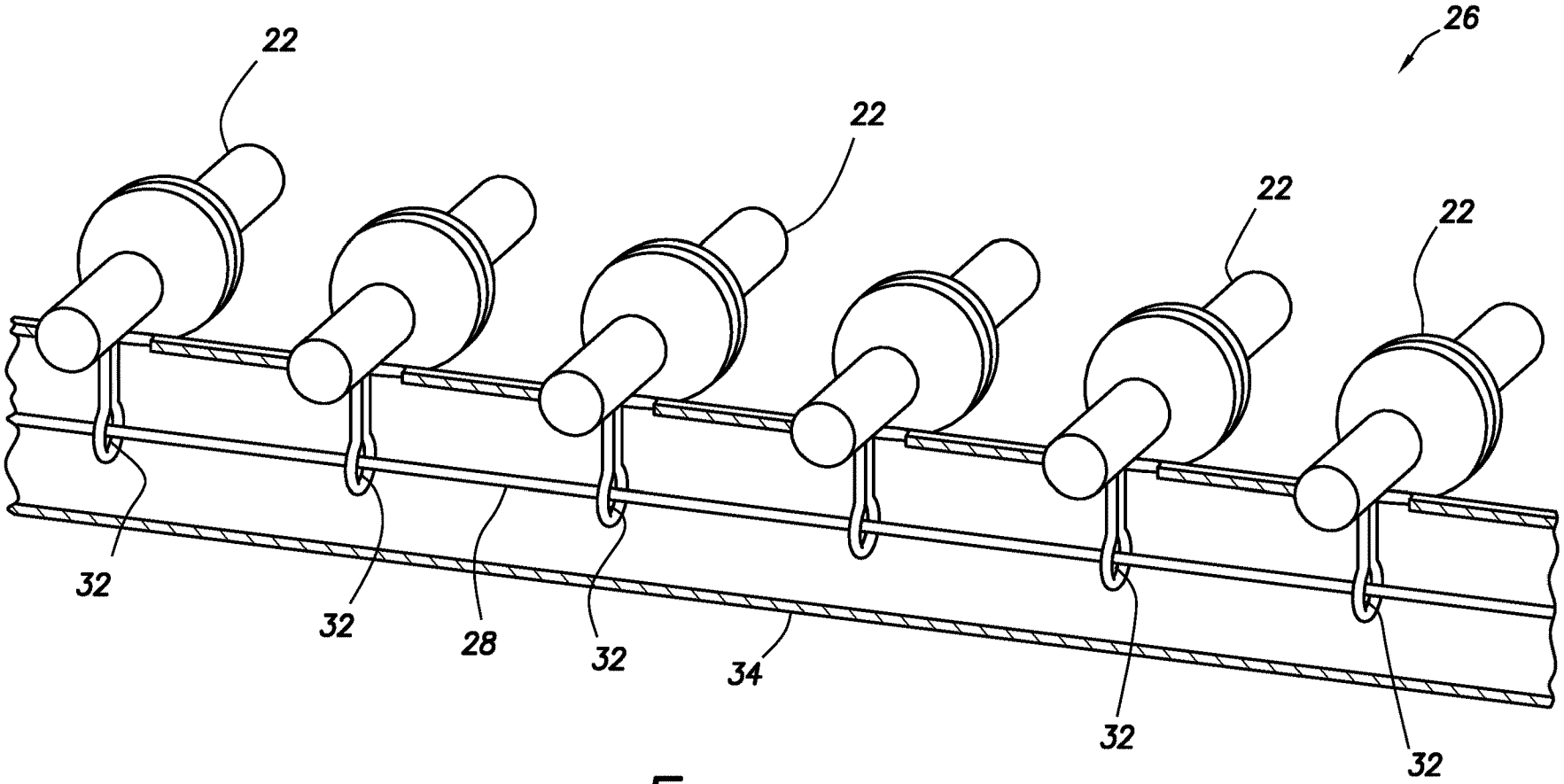
FIG. 6 is a representative perspective and partially cross-sectional view of another example of the release mechanism.

Referring additionally now to FIG. 6, another example of the release mechanism 26 is representatively illustrated. In this example, the member 28 is in the form of a flexible wire or cable extending through the openings 32 of the plugging devices 22.

Each plugging device 22 is retained adjacent the tube 34 as long as the member 28 extends through the opening 32 of the plugging device. However, when the member 28 is retracted, so that it no longer extends through the opening 32, the corresponding plugging device 22 is released for deployment into the well.

When the member 28 is displaced axially or longitudinally, the plugging devices 22 are sequentially released. In other examples, multiple plugging devices 22 can be released at the same time by retaining the multiple plugging devices at a same location along the member 28.

Note that a speed of displacement of the member 28 is proportional to a rate of release of the plugging devices 22 from the release mechanism 26. Faster displacement of the member 28 will result in an increased rate of release of the plugging devices 22, and slower displacement of the member will result in a decreased rate of release of the plugging devices.

Figure 7:
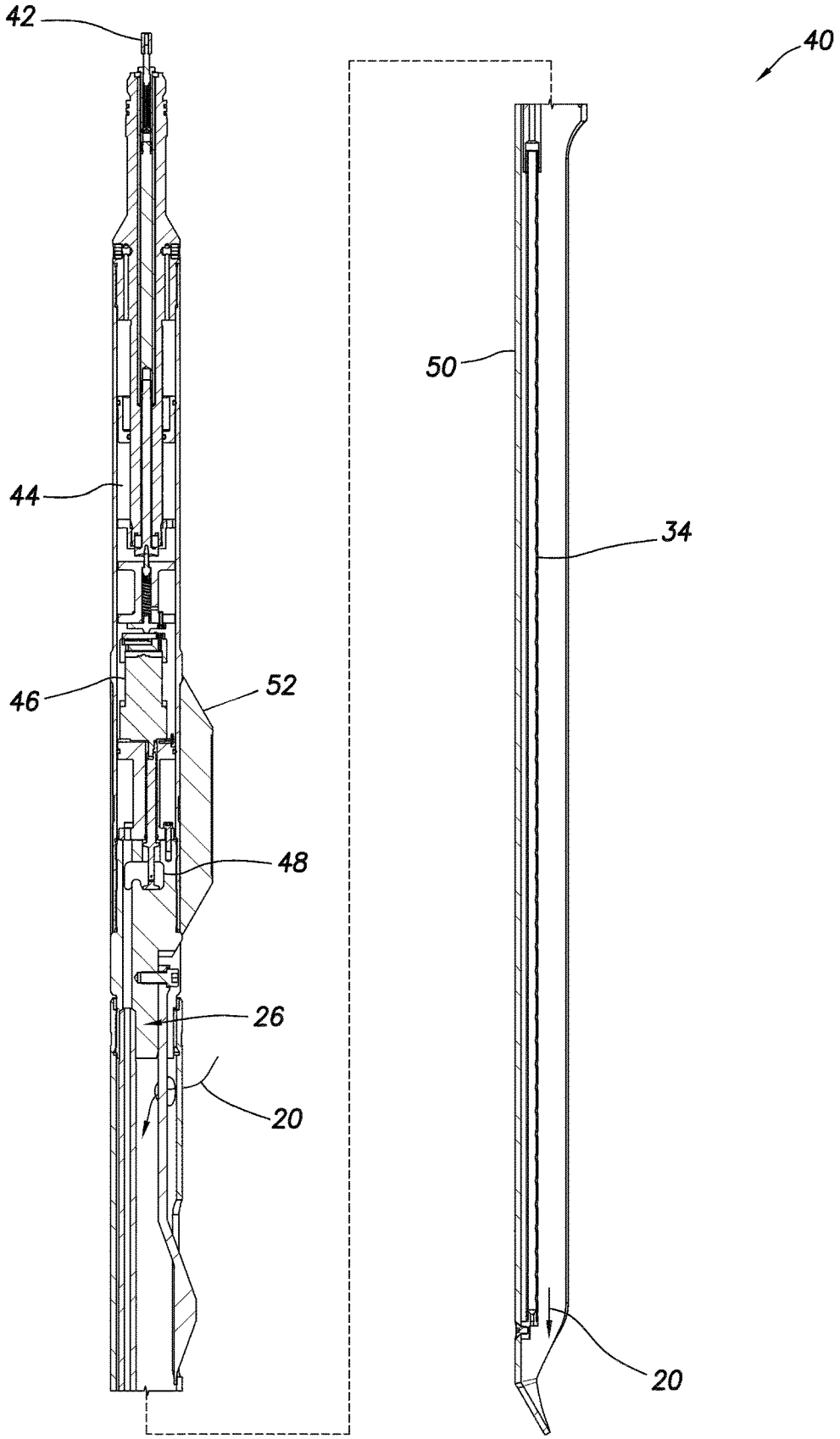
FIG. 7 is a representative cross-sectional view of an example of the plugging device launcher configured for positioning downhole in a well.

Referring additionally now to FIG. 7, an example of a downhole plugging device launcher 40 is representatively illustrated. The FIG. 7 plugging device launcher 40 may be used with the plugging device launcher 24 described above, or it may be used separately.

In this example, the plugging device launcher 40 is configured to be conveyed into a well (such as, into the wellbore 12 in the FIG. 1 system 10). The plugging device launcher 40 may be conveyed by wireline, slickline, coiled tubing or another type of conveyance.

As depicted in FIG. 7, the plugging device launcher 40 includes an upper electrical connector 42 (e.g., for connection to an electrical conductor of a wireline), an oil-filled chamber 44, an electrical motor 46 or other type of actuator, a drum, spool or reel 48 driven by the motor or actuator, and the release mechanism 26 of FIG. 6. Only the tube 34 of the release mechanism 26 is visible in FIG. 7 (e.g., after the elongated member 28 has been retracted out of engagement with the openings 32, and after the plugging devices 22 have all been released). Note that any of the release mechanism 26 examples described herein may be used in the plugging device launcher 40.

When the motor 46 is operated, the member 28 is wound about the reel 48, thereby withdrawing the member from the openings 32. Flow of the fluid 20 through a slotted outer housing 50 of the plugging device launcher 40 carries the plugging devices 22 downhole.

In an inclined wellbore, preferably a slot in the outer housing 50 faces upward. An eccentric pump-down bushing 52 and/or a cantilever spring may be used to orient the slot upward.

The motor 46 speed and duration can be controlled by a control system of a wireline truck or operations cab. Thus, a rate of release of the plugging devices 22 can be varied by varying a speed of the motor 46. Other actuators or means to withdraw or retract the member include displacement of a packer setting tool, retraction of a spring, use of a piston and ambient chamber, etc.

One advantage of the plugging device launcher 40 is that excess plugging devices 22 can be run into the well. When all the perforations 18 are plugged and the well pressures up (e.g., pressure in the wellbore 12 increases due to the lack of a flow path to the formation 14), the motor 46 can be turned off to thereby cease further plugging device 22 release. Excess plugging devices 22 can then be retrieved from the well with the plugging device launcher 40.

Referring additionally now to FIGS. 8-13, various views of an example of the plugging device launcher 24 are representatively illustrated. The plugging device launcher 24 may be used in the system 10 and method of FIG. 1, or it may be used with other systems and methods.

The FIGS. 8-13 plugging device launcher 24 utilizes the FIG. 6 release mechanism 26. However, in other examples, other types of release mechanisms may be used.

The actuator for the FIGS. 8-13 plugging device launcher 24 is a rotary hydraulic actuator 54 combined with a pawl mechanism 56. For convenience, the reel 48 on which the member 28 is wound is sized so that only one plugging device 22 is released per stroke of the hydraulic actuator 54 in the FIGS. 8-13 example. A hydraulic or electric motor could be used in place of the rotary hydraulic actuator 54.

Figure 8:
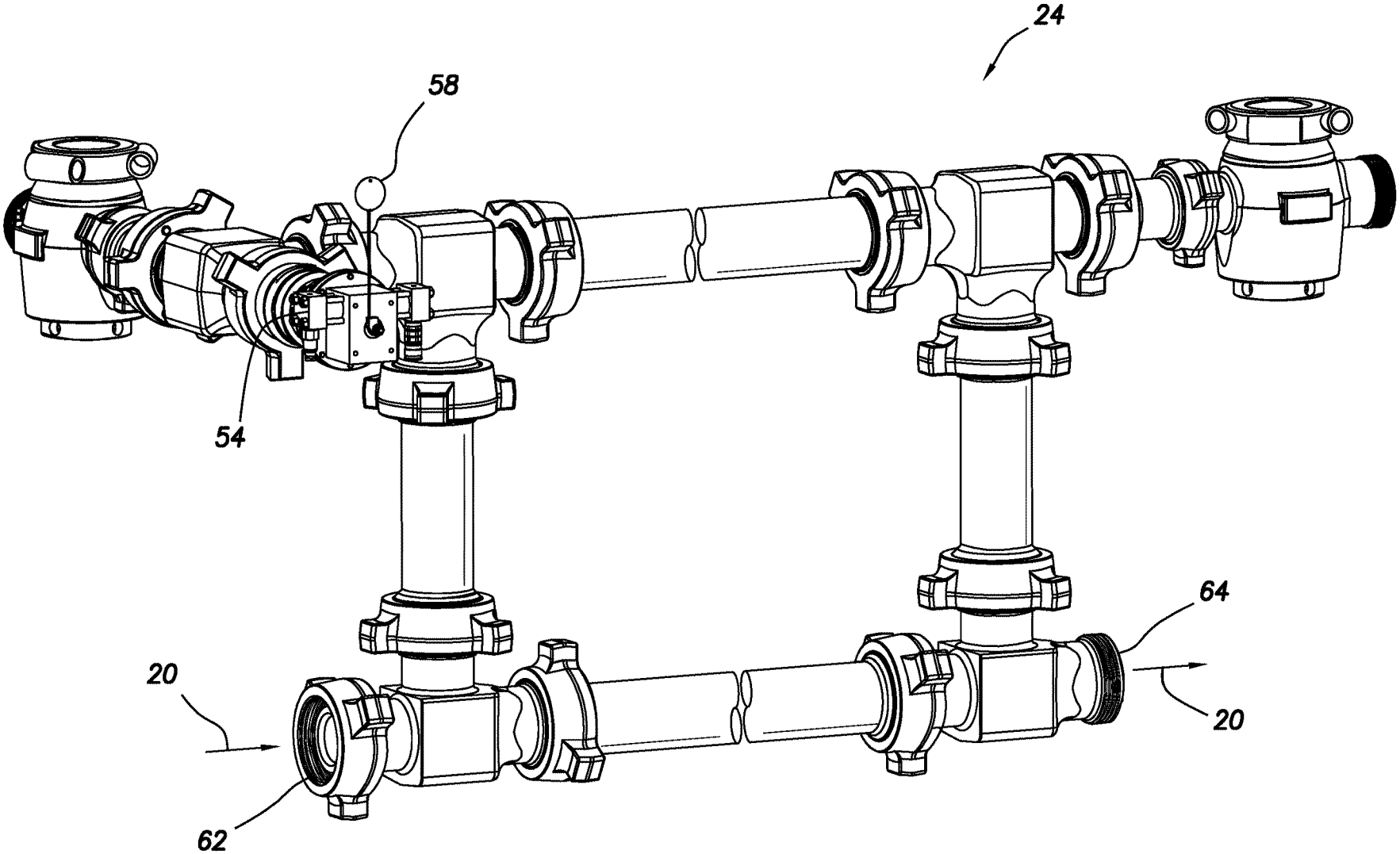
FIG. 8 is a representative perspective side view of an example of the plugging device launcher configured for positioning at a surface location.

FIG. 8 depicts an outside of the plugging device launcher 24. A position indicator flag 58 is used to indicate to an operator that a shaft 60 (see FIG. 11) that transmits rotation from the actuator 54 to the reel 48 is rotating properly.

Fluid 20 flowing into the well is directed to a treatment line inlet 62 (connected to the pump 27 in the FIG. 1 system 10). The rotary hydraulic actuator 54 is operated to release the plugging devices 22 into a treatment line outlet 64 (connected to the wellhead 29 in the FIG. 1 system 10). From the treatment line outlet 64, the released plugging devices 22 enter the well, are conveyed by the fluid 20 flow through the well and eventually land on and block flow through a perforation 18 or other opening.

Figure 9:
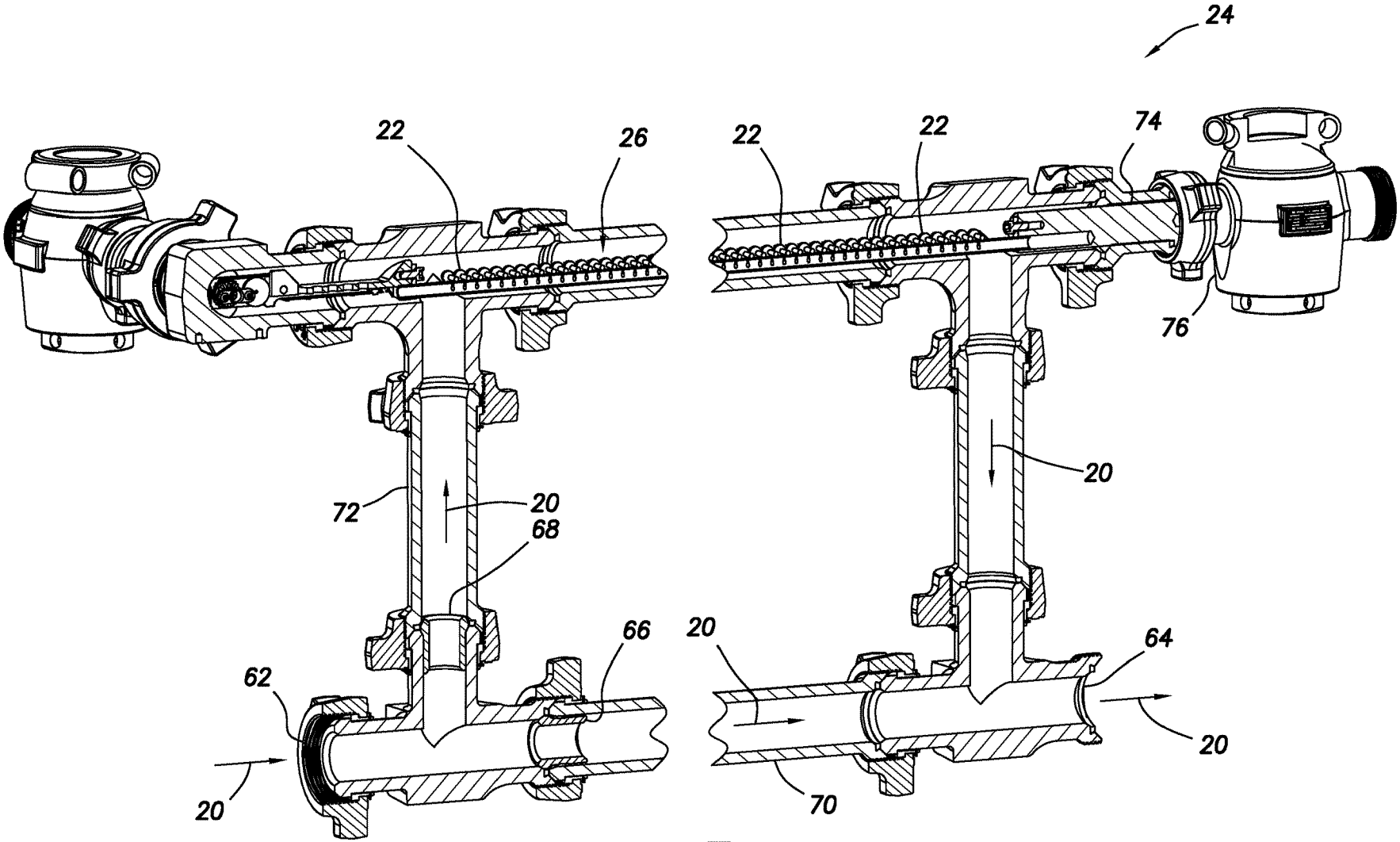
FIG. 9 is a representative cross-sectional view of the FIG. 8 plugging device launcher.

In FIG. 9, a cross section of the plugging device launcher 24 is representatively illustrated. There are two flow restrictors 66, 68 positioned in respective flow lines 70, 72. The restrictor 66 in the flow line 70 is used to divert some flow of the fluid 20 through the flow line 72 leading to the release mechanism 26. This restrictor 66 is not strictly necessary, because the fluid 20 should readily flow through the flow line 72.

The restrictor 68 in the flow line 72 is used to limit a flow rate of the fluid 20 around the plugging devices 22, in order to prevent damage to the plugging devices. The restrictor 68 is also not necessary in all examples.

A plug 74 is visible in FIG. 9. The plug 74 prevents the plugging devices 22 from getting caught in a dead space near a reload access valve 76. The reload access valve 76 is used to access the release mechanism 26 when it is desired to load additional plugging devices 22 or otherwise maintain or reset the release mechanism.

Figure 10:
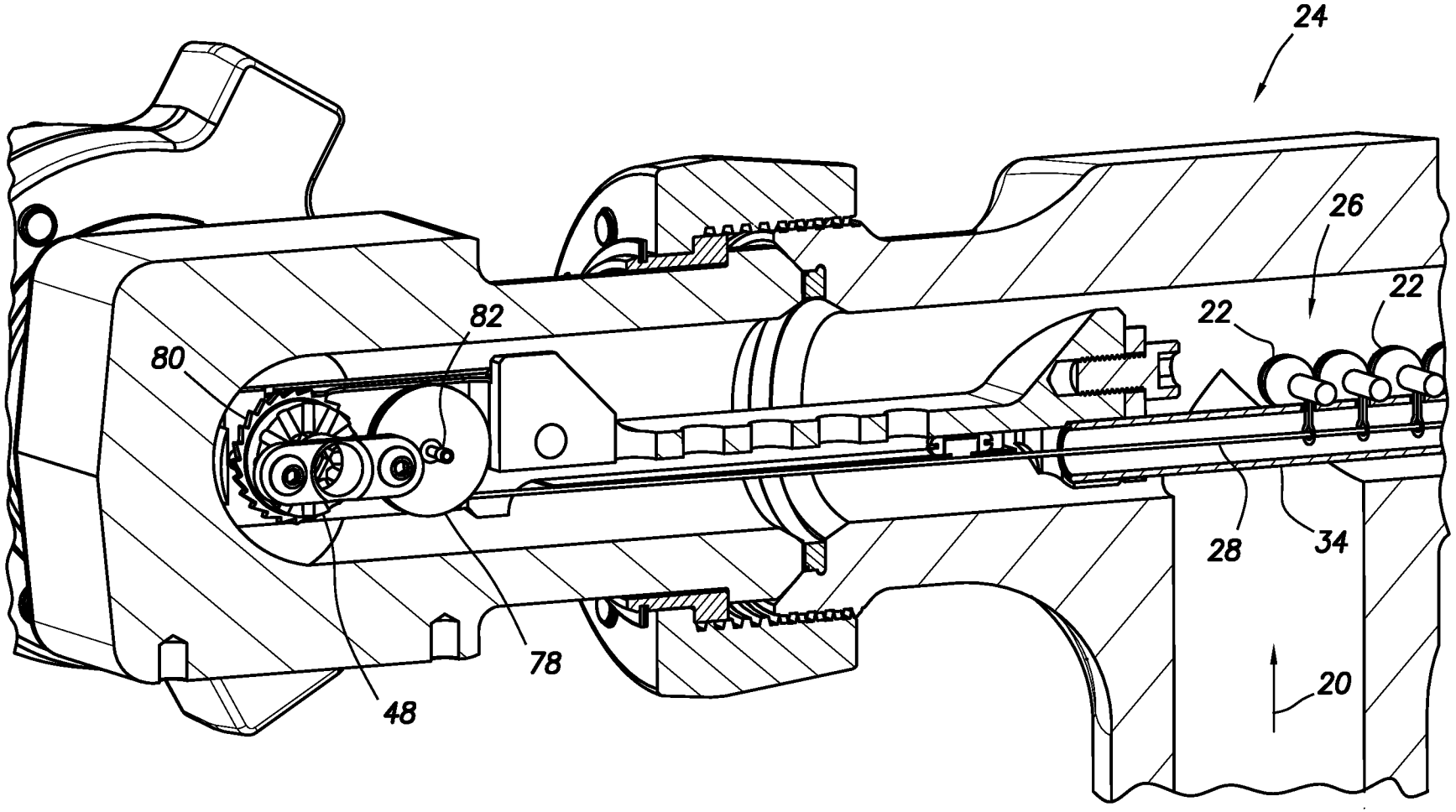
FIG. 10 is a representative perspective and cross-sectional view of the plugging device launcher, depicting a reel and level guide section of the release mechanism.

In FIG. 10, a more detailed view of the reel 48 and a level guide 78 is representatively illustrated. The reel 48 has a pawl 80 on it to prevent entanglement of the member 28 during installation of the release mechanism 26.

In operation, the level guide 78 rotates due to friction against the member 28 as it is wound onto the reel 48. The level guide 78 rotates on a threaded shaft 82 that will laterally advance the member 28 at an appropriate rate to prevent the member from stacking onto itself on the reel 48. The purpose of this is to keep the feed rate (displacement speed) of the member 28 constant.

Figure 11:
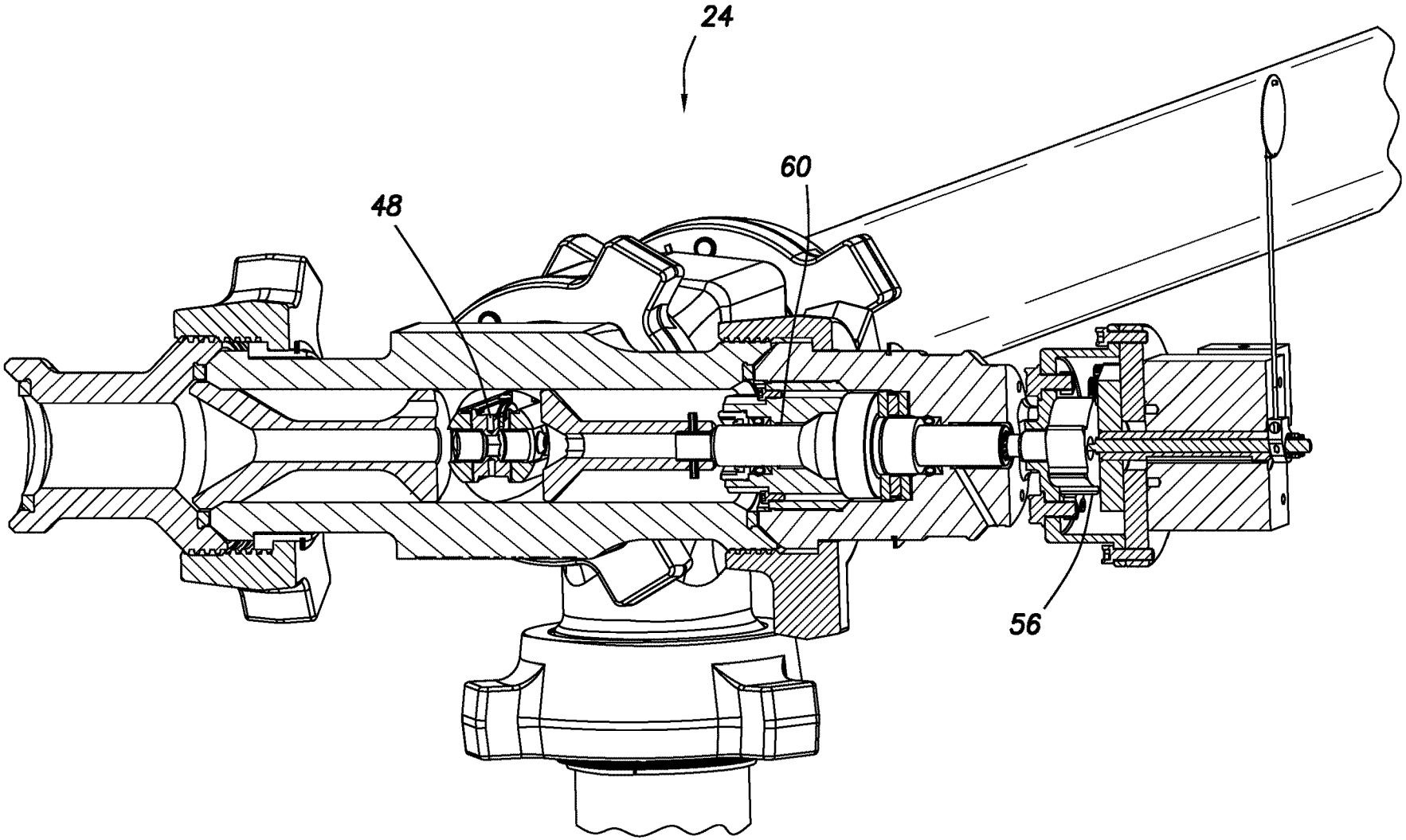
FIG. 11 is a representative perspective and cross-sectional view of the plugging device launcher, depicting a pawl mechanism and shaft section of the release mechanism.

In FIG. 11, a cross-sectional view of the plugging device launcher 24 is representatively illustrated. In this view, the manner in which the reel 48 is rotated via the pawl mechanism 56 can be seen.

Figure 12:
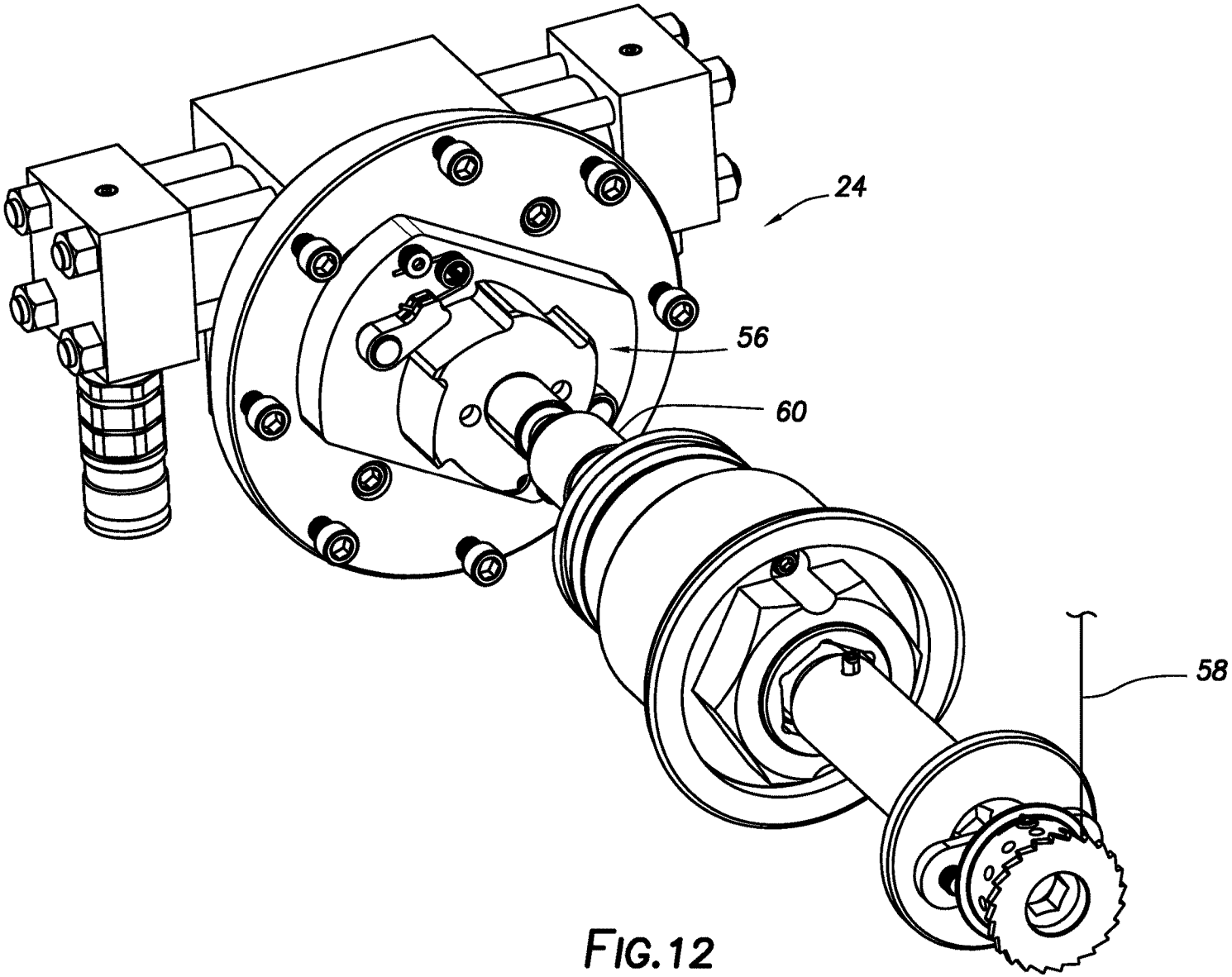
FIG. 12 is a representative detailed perspective view of the pawl mechanism.

In FIG. 12, a more detailed view of the pawl mechanism 56 is representatively illustrated. In this view, the manner in which rotation of the shaft 60 is controlled by the pawl mechanism 56 can be seen.

Figure 13:
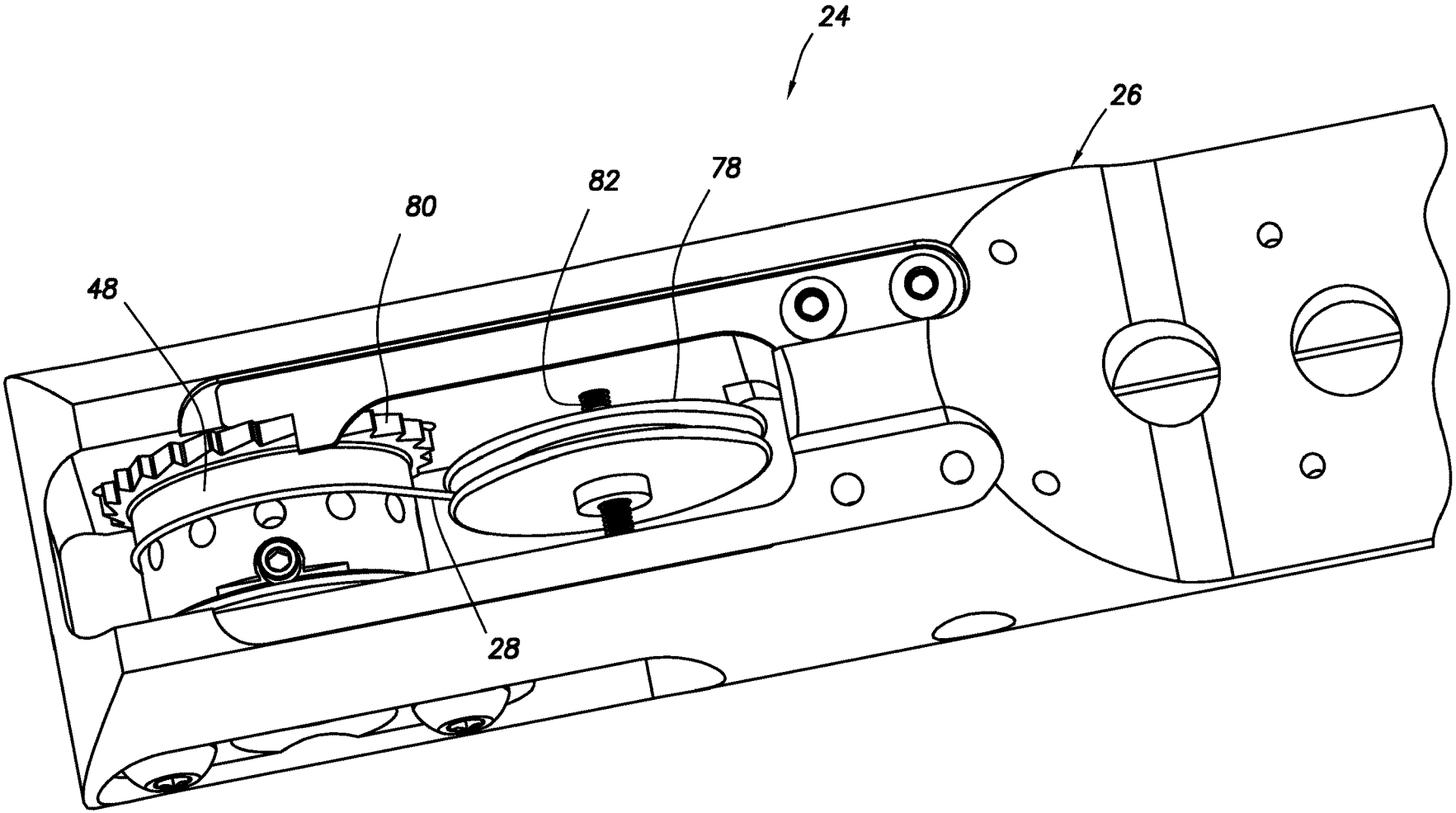
FIG. 13 is a representative detailed perspective view of the reel and level guide section of the release mechanism.

In FIG. 13, a more detailed view of the reel 48 and level guide 78 is representatively illustrated. In this view, the manner in which the level guide 78 controls winding of the member 28 onto the reel 48 can be seen.

The plugging device launcher 24 described herein allows precise release of plugging devices 22, thereby providing for accurate spacing of the plugging devices. Another advantage is that more than one release of plugging devices 22 may be accomplished. Multiple launchers 24 can be utilized (for example, connected in parallel) when more than one release of plugging devices 22 per treatment stage is desired.

In the case of the downhole plugging device launcher 40 described above, extremely slow release of plugging devices 22 may be accomplished without danger of releasing extra plugging devices above new perforations 18.

It may now be appreciated that the above disclosure provides to the art a plugging device launcher 24, 40 for use with a subterranean well. In one example, the plugging device launcher 24, 40 can include: a release mechanism 26 comprising an actuator 46, 54 operative to displace at least one elongated member 28. The at least one elongated member 28 is engaged with at least one plugging device 22.

In any of the examples described above:

The plugging device launcher 24 can include a flow line 70 configured to connect between a pump 27 and a wellhead 29 of the well.

The plugging device launcher 40 may include an outer housing 50 containing the release mechanism 26. The outer housing 50 may be configured to be positioned downhole in the well.

The "at least one" elongated member 28 may be a single elongated member, the "at least one" plugging device may comprise multiple plugging devices, and the single elongated member 28 may be engaged with each of the multiple plugging devices 22. The single elongated member 28 may be received in an opening 32 of each of the multiple plugging devices 22.

The "at least one" elongated member 28 may comprise multiple elongated members, the "at least one" plugging device 22 may comprise multiple plugging devices, and each of the elongated members 28 may be engaged with a respective one of the multiple plugging devices 22. Each of the elongated members 28 may be received in an opening 32 of the respective one of the multiple plugging devices 22.

The actuator 46, 54 may be configured to longitudinally displace or rotate the elongated member 28. The actuator 46, 54 may be configured to wind the elongated member 28 onto a reel 48.

A method of releasing plugging devices 22 into a subterranean well is also provided to the art by the above disclosure. In one example, the method can include placing a plugging device launcher 24, 40 in communication with a wellbore 12 of the well; and operating an actuator 46, 54 of the plugging device launcher 24, 40, thereby displacing at least one elongated member 28 of the plugging device launcher 24, 40. The displacing step can include disengaging the at least one elongated member 28 from at least one of the plugging devices 22.

In any of the examples described above:

The "at least one" elongated member 28 may be a single elongated member, and the disengaging step may include disengaging the single elongated member 28 from the plugging devices 22. The disengaging step may further include withdrawing the single elongated member 28 from an opening 32 of each of the plugging devices 22. The disengaging step may include sequentially disengaging the single elongated member 28 from the plugging devices 22.

The "at least one" elongated member 28 may comprise multiple elongated members, and the disengaging step may include disengaging each of the elongated members 28 from a respective one of the plugging devices 22. The disengaging step may further include withdrawing each of the elongated members 28 from an opening 32 of the respective one of the plugging devices 22. The disengaging step may include sequentially disengaging each of the elongated members 28 from a respective one of the plugging devices 22.

The displacing step may include longitudinally displacing or rotating the "at least one" elongated member 28. The displacing step may include winding the "at least one" elongated member 28 onto a reel 48.

The placing step may include connecting the plugging device launcher 24 between a pump 27 and a wellhead 29 of the well. The placing may include positioning the plugging device launcher 40 in the wellbore 12.

The above disclosure provides to the art a plugging device launcher 24, 40, in which member 28 (such as, a wire, pin, helical spring or rod) is disengaged from a plugging device 22 in order to release the plugging device 22. Multiple wires, springs, pins or rods may be disengaged from respective multiple plugging devices 22. A single member 28 (e.g., wire, spring, pin or rod) may be disengaged from multiple plugging devices 22.

The plugging device 22 may be released through a wall of a tube 34 in which the member 28 is received. A loop, opening 32, hole or other receiver of the plugging device 22 may extend through the wall of the tube 34.

The member 28 may be displaced axially or rotated to release the plugging device 22. Multiple plugging devices 22 may be released sequentially (e.g., in order, one after another) from the launcher 24, 40 into a well. A timing between releases of the plugging devices 22 may be selected to provide for each released plugging device 22 landing on a respective perforation 18 or other opening to thereby block flow through the perforation or other opening.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A plugging device launcher for controllably deploying at least one plugging device into a subterranean well, the plugging device launcher comprising:

a release mechanism comprising an actuator operative to displace an elongated member, in which the elongated member is received in an opening of the at least one plugging device, thereby releasably securing the at least one plugging device in the plugging device launcher, and in which the elongated member is configured to be withdrawn from the opening of the at least one plugging device, thereby releasing the at least one plugging device from the plugging device launcher and launching the at least one plugging device into the well.

2. The plugging device launcher of claim 1, further comprising a flow line configured to connect between a pump and a wellhead of the well, in which a portion of fluid flow through the flow line is diverted to the plugging device launcher.

3. The plugging device launcher of claim 1, further comprising an outer housing containing the release mechanism, and in which the outer housing is configured to be positioned downhole in the well.

4. The plugging device launcher of claim 1, in which the at least one plugging device comprises multiple plugging devices, and the elongated member is engaged with each of the multiple plugging devices.

5. The plugging device launcher of claim 4, in which the elongated member is received in a respective opening of each of the multiple plugging devices.

6. The plugging device launcher of claim 1, in which the plugging device launcher comprises multiple elongated members, the at least one plugging device comprises multiple plugging devices, and each of the elongated members is engaged with a respective one of the multiple plugging devices.

7. The plugging device launcher of claim 6, each of the elongated members is received in a respective opening of the respective one of the multiple plugging devices.

8. The plugging device launcher of claim 1, in which the actuator is configured to longitudinally displace the elongated member.

9. The plugging device launcher of claim 1, in which the actuator is configured to rotate the elongated member.

10. The plugging device launcher of claim 1, in which the actuator is configured to wind the elongated member onto a reel.

11. A method of releasing plugging devices into a subterranean well, the method comprising:

loading the plugging devices into a plugging device launcher, in which at least one of the plugging devices is releasably secured in the plugging device launcher by an elongated member which is received in an opening of the at least one of the plugging devices;

placing the plugging device launcher in communication with a wellbore of the well; and operating an actuator of the plugging device launcher, thereby displacing the elongated member of the plugging device launcher, the displacing comprising withdrawing the elongated member from the at least one of the plugging devices, thereby releasing the at least one of the plugging devices from the plugging device launcher and launching the at least one of the plugging devices into the well.

12. The method of claim 11, in which the withdrawing comprises disengaging the elongated member from the multiple plugging devices.

13. The method of claim 12, in which the disengaging further comprises withdrawing the elongated member from a respective opening of each of the plugging devices.

14. The method of claim 12, in which the disengaging further comprises sequentially disengaging the elongated member from the plugging devices.

15. The method of claim 11, in which the plugging device launcher comprises multiple elongated members, and the withdrawing comprises disengaging each of the elongated members from a respective one of the plugging devices.

16. The method of claim 15, in which the disengaging further comprises withdrawing each of the elongated members from a respective opening of the respective one of the plugging devices.

17. The method of claim 15, in which the disengaging further comprises sequentially disengaging each of the elongated members from the respective one of the plugging devices.

18. The method of claim 11, in which the displacing comprises longitudinally displacing the elongated member.

19. The method of claim 11, in which the displacing comprises rotating the elongated member.

20. The method of claim 11, in which the displacing comprises winding the elongated member onto a reel.

21. The method of claim 11, in which the placing comprises connecting the plugging device launcher between a pump and a wellhead of the well.

22. The method of claim 11, in which the placing comprises positioning the plugging device launcher in the wellbore.

* * * * *